US008789606B1

(12) United States Patent
Lugo

(10) Patent No.: US 8,789,606 B1
(45) Date of Patent: Jul. 29, 2014

(54) SYSTEM FOR CONTROLLING FUNCTIONS OF A SUBSEA STRUCTURE, SUCH AS A BLOWOUT PREVENTER

(75) Inventor: Mario R. Lugo, Houston, TX (US)

(73) Assignee: Trendsetter Engineering, Inc., Houston, TX (US)

( * ) Notice: Subject to any disclaimer, the term of this patent is extended or adjusted under 35 U.S.C. 154(b) by 116 days.

(21) Appl. No.: 13/228,627

(22) Filed: Sep. 9, 2011

(51) Int. Cl.
*E21B 33/035* (2006.01)
*E21B 29/12* (2006.01)
*E21B 33/127* (2006.01)

(52) U.S. Cl.
USPC ..... 166/363; 166/364; 166/345; 166/350; 166/250.15; 166/338; 166/85.4

(58) Field of Classification Search
USPC ..... 166/338, 345, 350, 351, 355, 358, 363, 166/364, 368, 250.15, 85.4; 175/40, 41; 367/2, 6, 131, 133; 340/853.3
See application file for complete search history.

(56) References Cited

U.S. PATENT DOCUMENTS 3,353,149 A * 11/1967 Frantz, Jr. et al. ..... 367/2
3,405,387 A * 10/1968 Koomey et al. ..... 367/133
3,487,486 A * 1/1970 Terry et al. ..... 441/29
3,583,445 A * 6/1971 Harbonn et al. ..... 141/1
4,367,794 A * 1/1983 Bednar et al. ..... 166/66.5
4,806,928 A * 2/1989 Veneruso ..... 340/853.3
7,216,714 B2 5/2007 Reynolds
7,222,674 B2 5/2007 Reynolds
7,690,433 B2 4/2010 Reynolds
2002/0104661 A1* 8/2002 Head ..... 166/380
2007/0173957 A1* 7/2007 Johansen et al. ..... 700/9
2009/0287414 A1* 11/2009 Vickery ..... 701/220
2010/0025045 A1* 2/2010 Lake et al. ..... 166/373
2010/0181075 A1 7/2010 Reynolds
2011/0073303 A1* 3/2011 Taherian et al. ..... 166/254.2
2012/0000664 A1* 1/2012 Nas et al. ..... 166/344

OTHER PUBLICATIONS

Acoustic Control Systems for BOP operation, dated Apr. 2006, in BOP Control Systems Review, attached and downloaded from the internet on Apr. 2, 2013.*

Robert H. Rothberg et al., Diverless Subsea Systems, A Reprint from Oil & Gas Journal International Petroleum News and Technology, Apr. 5, 1993, PennWell Publishing Company.

* cited by examiner

*Primary Examiner* — James Sayre
(74) *Attorney, Agent, or Firm* — Egbert Law Offices, PLLC

(57) ABSTRACT

A system for controlling functions of a subsea structure, such as a blowout preventer, has a plurality of actuators respectively affixed to a plurality of controls of the subsea structure, and an acoustic signal generator positioned remotely from the plurality of actuators. Each of the plurality of actuators has a transponder connected thereto. The acoustic signal generator produces an acoustic signal so as to actuate at least one of the plurality of actuators. Each of the actuators is an electrically-powered torque wrench having a battery affixed there to so as to supply power thereto. An induction generator can transmit an electromagnetic wave along the tubing associated with the blowout preventer so as to recharge the batteries of the torque wrenches.

8 Claims, 3 Drawing Sheets

SYSTEM FOR CONTROLLING FUNCTIONS OF A SUBSEA STRUCTURE, SUCH AS A BLOWOUT PREVENTER

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the control of subsea structures and the control of blowout preventers. More particularly, the present invention the relates to systems for controlling the operation of the controls of the blowout preventer. Additionally, the present invention relates to electrically-powered wrenches as used for the actuation of the controls of the blowout preventer.

2. Description of Related Art Including Information Disclosed Under 37 CFR 1.97 and 37 CFR 1.98.

When drilling in deepwater from a floating drilling vessel, a blowout preventer stack is typically connected to a wellhead at the sea floor. A diverter system is also mounted under the rig sub-structure at the surface via a marine riser system. The blowout preventer stack is employed to provide a means to control the well during drilling operations and provide a means to both secure and disconnect from the well in the event of the vessel losing position due to automatic station keeping failure, weather, sea state, or mooring failure.

A conventionally configured blowout preventer stack is typically arranged in two sections, including an upper section (i.e. the lower marine riser package) which provides an interface to a marine riser via a riser adapter located at the top of the package. The riser adapter is secured to a flex-joint which provides angular movement to compensate for vessel offset. The flex-joint assembly, in turn, interfaces with a single or dual element hydraulically-operated annular-type blowout preventer, which allows for the stripping of drill pipe or tubulars which are run in and out of the well. Also located in the lower marine riser package is a hydraulically-actuated connector which interfaces with a mandrel, typically located on the top of the blowout preventer stack's lower section. The blowout preventer stack's lower section typically includes a series of hydraulically-operated ram-type blowout preventers connected together via bolted flanges in a vertical plane creating a ram stack section. In turn, the ram stack section interfaces to a hydraulically-latched wellhead connector via a bolted flange. The wellhead connector interfaces to the wellhead, which is a mandrel profile integral to the wellhead housing, which is the conduit to the wellbore.

Conduit lines integral to the marine riser provide for hydraulic fluid supply to the blowout preventer stack control system and communication with the wellbore annulus via stack-mounted gate valves. The stack-mounted gate valves are arranged in the ram stack column at various positions so as to allow circulation through the blowout preventer stack column depending on which individual ram is closed.

The unitized blowout preventer stack is controlled by means of a control system containing pilot and directional control valves which are typically arranged in a control module or pod. Pressure regulators are typically included in the control pod to allow for operating pressure increase/decrease for the hydraulic circuits which control the functions on the unitized blowout preventer stack. These valves, when commanded from the surface, either hydraulically or electro-hydraulically direct pressurized hydraulic fluid to the function selected. Hydraulic fluid is supplied to the blowout preventer stack via a specific hydraulic conduit line. In turn, the fluid is stored at pressure in stack-mounted accumulators, which supply the function of the directional control valves contained in redundant control pods mounted on the lower marine riser package or upper section of the blowout preventer stack.

A hydraulic power unit and accumulator banks are installed within the vessel to provide a continuous source of replenishment fluid that is delivered to the subsea blowout preventer stack-mounted accumulators via a hydraulic rigid conduit line and stored at pressure. Recent deepwater developments have placed increased demands for well control systems so as to require dramatic increases in the functional capability of the subsea blowout preventer stack and, in turn, the control system operating methodologies and complexities. These additional operational requirements and complexities have had a serious effect on system reliability, particularly in the control system components and interface.

In the past, various patents and publications have described techniques of the control of the blowout preventer systems. Additionally, various prior art patents and publications have been directed to controlling the functions of other subsea structures, such as subsea trees. In each of these subsea structures, there are several valves that are incorporated into the structure that must be controlled so as to carry out the desired function.

An early publication directed to the diverless control of such subsea structures is found from an article in Oil & Gas Journal of Apr. 5, 1993. This article describes a diverless subsea system in which an integrated template system is connected by short jumpers to the various valves of the subsea structure. As a result, the integrated template system can be lowered so as to be in proximity to the blowout preventer. An ROV can then be lowered into the water and operatively controlled from the surface so as to move in position so as to operate controls on the integrated template. The operation of these controls effectively allows for the control of the functions of the blowout preventer, along with the operation of other subsea structures.

U.S. Pat. No. 7,216,714, issued on May 15, 2007 to G. E. Reynolds, describes a modular, distributed, ROV retrievable subsea control system for use with a module adapted for use in a modular blowout preventer stack for use subsea. The control module includes a housing that is adapted to be manipulated by a remotely operated vehicle (ROV) with a stab portion adapted to be received into a blowout preventer stack control module receiver. Control electronics are adapted to control a predetermined function with respect to the BOP stack. These control electronics are disposed within the housing and connected to one or more controllable devices by a wet mateable connector interface.

U.S. Pat. No. 7,222,674, issued on May 29, 2007 also to G. E. Reynolds, describes a distributed function control module adapted for use in a blowout preventer stack for use subsea. This control module also comprises a housing that is adapted to be manipulated by a ROV. A stab portion is adapted to be received into a blowout preventer stack control module receiver. Control electronics are disposed within the housing and are connected to one or more controllable devices by a wet mateable connector interface. The control electronics are adapted to control a predetermined function of the BOP stack.

U.S. Pat. No. 7,690,433 issued on Apr. 6, 2010 also to G. E. Reynolds, provides a distributed function control module adapted for use in a modular blowout preventer stack for use subsea. This control module includes a housing that is adapted to be manipulated by a remotely operated vehicle. A stab portion is adapted to be received into a blowout preventer stack control module receiver. Control electronics are disposed within the housing and are connected to one or more controllable devices by a wet mateable connector interface. The control electronics are adapted to control a predetermined function of the blowout preventer stack.

U.S. Patent Publication No. 2010/0181075, published on Jul. 22, 2010 also to G. E. Reynolds, teaches a distributed function control module having a housing that is adapted to be manipulated by a ROV. A stab portion is adapted to be received into a BOP stack control module receiver. Control electronics are disposed within the housing. The control electronics are connected to one or more controllable devices by a wet mateable connector interface. The control electronics are adapted to control a predetermined function with respect to BOP stack.

Unfortunately, with these prior art patents, it is necessary to employ an ROV in order to carry out the actuation of the various functions of the blowout preventer. ROVs are very expensive. Skilled personnel are required so as to properly manipulate the ROV so that the ROV can engage with the wet mateable interfaces. In the event of a need to control a function of the blowout preventer, the ROV must be deployed from a ship and then moved into a proper position in the deep water. This is a very time consuming operation. As such, the ROV may not be available in order to carry out the control of the blowout preventer in emergency circumstances. As such, a need has developed whereby the control of the blowout preventer can carried out remotely by a vessel located on the surface of the body of water.

It is known in the past that ROV can carry torque wrenches thereon. A torque wrench is a tool that is used to precisely apply a specific torque to a fastener, such as a nut or bolt. It is usually in the form of a socket wrench with special internal mechanisms. Typically, torque wrenches are used where the tightness of screws and bolts is crucial. It allows the operator to measure the torque applied to fastener so that it can be matched to the specification for a particular application. This permits proper tension and loading of all parts. A torque wrench measures torque as a proxy for bolt tension. In the subsea environment, such torque wrench can be carried by the ROV to a desired location. If it is desired to operate the torque wrench in the subsea environment, then the ROV can supply hydraulic power to the hydraulically-powered torque wrench. As a result, the ROV is available so as to apply the torque wrench to the controls of a blowout preventer, as needed. For example, if a particular control of the blowout preventer must be actuated, then the ROV can deliver the torque wrench to its desired location at the control of the blowout preventer. The torque wrench is hydraulically-actuated so as to manipulate the control. In all circumstances, it is still necessary for the ROV to be deployed, to travel to the location of the blowout preventer, to align the torque wrench with the controls of the blowout preventer, and then to apply the necessary forces to the controls.

It is an object of the present invention to provide a control system for a blowout preventer that is diverless and ROV-less.

It is another object of the present invention to provide a subsea control system whereby acoustic signals from an acoustic signal generator can be utilized so as to control the functions of the blowout preventer.

It is another object of the present invention to provide a subsea control system which minimizes the expenses and complexities associated with the control of the blowout preventer and other subsea structures.

It is still another object of the present invention to provide a subsea control system whereby any function on the blowout preventer can be controlled by the acoustic control unit and the acoustic signal generator.

It is still another object of the present invention to provide a subsea control system whereby electrically-powered torque wrenches can be effectively utilized for the actuation of the controls of the blowout preventer.

It is a further object of the present invention to provide a subsea control system whereby batteries associated with such electrically-powered torque wrench can be easily recharged.

It is still a further object of the present invention to provide a subsea control system that is easy to use, relatively inexpensive and easy to manufacture.

These and other objects and advantages of the present invention will become apparent from a reading of the attached specification and appended claims.

BRIEF SUMMARY OF THE INVENTION

The present invention is a system for controlling functions of a subsea structure, such as a blowout preventer. The system of the present invention includes an acoustic signal generator, a transponder positioned remotely from the acoustic signal generator, and an actuator connected to the transponder. The actuator is directly connected to a control of the subsea structure. The acoustic signal generator is suitable for passing a signal to the transponder so as to drive the actuator.

In the present invention, the actuator is a torque wrench. In particular, the torque wrench has a head that is affixed to the control of the blowout preventer. The transponder extends outwardly of the torque wrench. The torque wrench is an electrically-powered torque wrench having a battery suitable for supplying power thereto. An induction generator is connected to the tubing associated with the blowout preventer so as to transmit an electromagnetic wave along the tubing to the blowout preventer so as to effectively recharge the batteries of the torque wrench.

The acoustic control unit is connected by a cable to the acoustic signal generator. A ship is positioned above the transponder. The acoustic control unit is positioned on the ship. A winch has as cable reel thereon. The cable extends around the cable reel. The winch is positioned on the ship. The winch is operable so as to raise or lower the acoustic signal generator.

The acoustic signal generator transmits sonar signals. The transponder will receive these sonar signals. In particular, the transponder comprises a plurality of transponders. The actuator includes a plurality of actuators separately connected to the subsea structure. The plurality of transponders are respectively connected to the plurality of actuators. The acoustic signal generator transmits a sonar signal of a desired frequency or volume corresponding to a desired actuation of one of the plurality of actuators.

The present invention is also a system for use in a body of water. The system comprises a blowout preventer having a plurality of controls thereon. The blowout preventer has a tubing extending therefrom toward a surface of the body of water. A plurality of electrically-powered wrenches are affixed respectively to the plurality of controls of the blowout preventer. Each of the plurality of electrically-powered wrenches is powered by a battery. An induction generating means is connected to the tubing so as to send an electromagnetic wave along the tubing so as to selectively recharge the batteries.

A plurality of transponders are connected respectively to the plurality of electrically-powered wrenches. An acoustic signal generator is positioned remotely from the plurality of transponders. The acoustic signal generator is suitable for transmitting an acoustic signal so as to actuate at least of one of the plurality of electrically-powered wrenches.

DETAILED DESCRIPTION OF THE INVENTION

Figure 1:
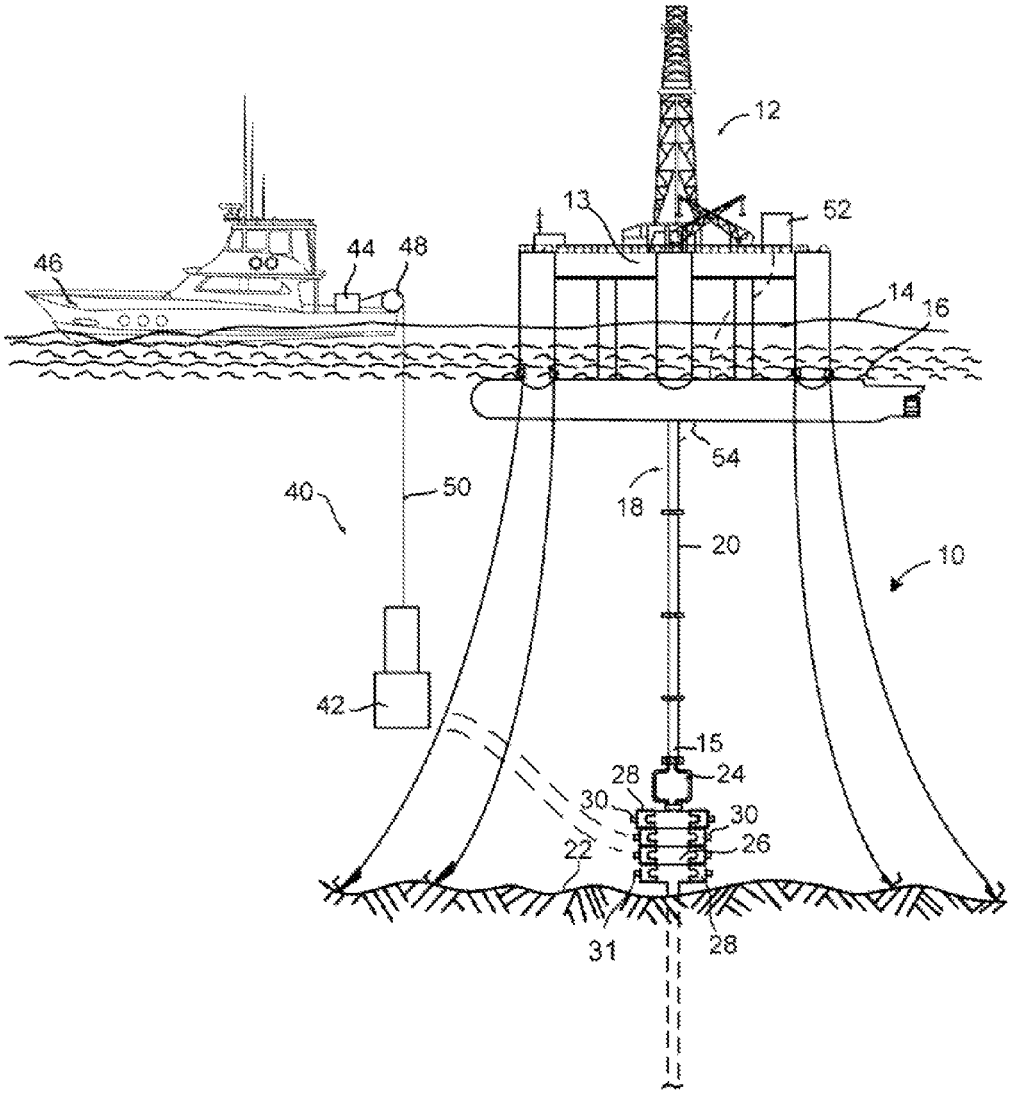
FIG. 1 is a diagrammatic illustration of the system of the present invention.

Referring to FIG. 1 illustrates the configuration of the oil well assembly as associated with the acoustic control unit of the present invention. In particular, the subsea blowout preventer control head assembly 10 is particularly shown as located in a body of water 16. A typical rig 12 is positioned on the surface of the body of water 16, such as in the Gulf of Mexico. A rig includes an extended riser 18 comprising a plurality of tubular elements 20 threaded end-to-end to define the entire riser 18 extending from the rig floor 13 to the seabed 22. For the purposes of the present invention, the rig 12 may be in water as deep at ten thousand feet. The riser 18 would be therefore ten thousand feet in overall length.

As part of the overall assembly 10, the lower end 15 of the riser 10 would terminate and attach to a hydril 24, which is known in the art. The hydril 24 is positioned above a series of blowout preventers 26, together which would prevent any blowout or excess pressure from downhole to be prevented by closing off the passage of the fluids up to the riser 18.

In FIG. 1, it can be seen that the blowout preventer 26 has a plurality of actuators 28 directly connected thereto. Each of the actuators 28 has a battery 31 extending therefrom. Additionally, each of the actuators 28 includes a transponder 30 extending therefrom.

It is important to note that in the present invention, that each of the actuators 28 is in the nature of a torque wrench. In particular, each of the actuators 28 are directly connected to a separate control of the blowout preventer 26. As such, when a particular torque wrench is actuated, then the torque wrench will apply a torque to the control so as to effectively control the function of the blowout preventer.

The present invention utilizes an acoustic control system 40. In particular, the acoustic control system 40 includes an acoustic signal generator 42, the transponders 30, an acoustic control unit 44, and a ship 46. As can be seen, and described hereinbefore, the actuators 28, along with their associated transponders 30, are positioned adjacent to the sea floor 22. The acoustic control unit 44 is positioned on the ship 46. The ship 46 is illustrated as floating on the surface 14 of the body of water 16. The ship 46 has a winch 48 that is positioned adjacent to the periphery of the ship 46. A cable 50 extends from the acoustic control unit 44, over the winch 48, and downwardly into the water 16 so as to connect with the acoustic signal generator 42. The acoustic signal generator 42 is suitable for generating acoustic signals or sonar of a desired volume or frequency for the control of the system of the present invention.

In operation, the acoustic signal generator 42 can receive a signal from the acoustic control unit 44 so as to produce the sonar signal. This sonar signal can be directed, at a considerable distance, to the various transponders 30 associated with each of the actuators 28 of the blowout preventer 26. As such, if one of the controls of the blowout preventer 28 must be actuated, then the acoustic signal generator 42 will send a signal to the respective transponder 30 so as to actuate that particular electrically-powered torque wrench. As such, the torque wrench will operate to open and/or close the particular control or valve on the blowout preventer 26. As a result, the present invention avoids the use of hydraulic accumulators, remote hydraulic mechanisms, tubings, manifolds, and control heads associated with the prior art. In the present invention, a separate actuator is associated with each of the separate controls. As such, the acoustic signal generator 42 can operate each of the particular actuators for the control of the blowout preventer. Each of the torque wrenches associated with the actuators 28 has a sufficient capacity so as to operate the control. In order to install each of the actuators 28 on the particular controls, it is only necessary to utilize the ROV over a short period of time so as to directly apply the torque wrench to each of the controls. It is not necessary to use an ROV, in any way, for the effective control of the actuators 28. Unlike the prior art, control is applied directly to the subsea structure rather than indirectly through a series of valves, connectors, accumulators, and other mechanisms. As a result, the present invention offers a more direct and assured control of the blowout preventer.

In the event in the need to operate a particular valve on the blowout preventer 26, the ship 46 can be maneuvered into a position. The acoustic control unit 44 is mounted on the ship 46 so as to move with the movement of the ship to the desired location. The acoustic signal generator 42 can then be lowered from the ship into the body of water 16 for a desired distance. Since the acoustic signals can travel a significant distance through the body of water 16, the acoustic signal generator 42 can be located remotely from the transponder 30. Generally, the acoustic signal generator 42 can be located five hundred feet or more away from the transponders 30. As such, precision in the placement of the ship 46 and the lowering of the acoustic signal generator 42 is not important.

If it is desired to open or close a particular valve on the blowout preventer 26, the acoustic control unit 44 will transmit an electric signal to the acoustic signal generator 42. The particular electrical signal is configured, with the control electronics, to allow the transponders 30 to produce a signal to the electrically-powered torque wrench so as to cause the torque wrench to rotate the particular control, as desired.

In the present invention, the manipulation of the blowout preventer 26 is accomplished without the need for divers or ROVs. Additionally, the ship 46 can be easily maneuvered into position as the acoustic signal generator 42 can be rapidly deployed in order to carry out the necessary manipulation of the blowout preventer in a safe, convenient and fast manner. Deployment of ROVs are not required in the system of the present invention (other than to connect each of the torque wrenches to each of the controls or valves of the blowout preventer 26).

In the past, a problem associated with such electrically-powered torque wrenches is the power requirement of the torque wrenches. It is known that batteries can be provided with each of the torque wrenches so as to supply sufficient power to the torque wrench so as to carry out its desired operation. However, when deployed on the blowout preventer 26, there is a possibility that the batteries will discharge and, eventually, lack sufficient power for the operation of the torque wrench. As such, this efficiency has inherently prevented any consideration of the use of electrically-powered torque wrenches in the manner described in the present invention.

In FIG. 1, it can be seen that there is an induction generator 52 that is positioned on the rig 13. The induction generator 52 has a line 54 that is connected to the tubing 20 extending to blowout preventer 26. As such, the induction generator 52 can supply an electromagnetic wave along the steel tubing 20 to the steel components of the blowout preventer 26. It is known that the induction generator, when operating in this manner, can remotely charge each of the batteries 30 associated with each of the electrically-powered torque wrenches of the actuators 28. Whenever it is determined that a battery has discharged sufficiently, then the induction generator 52 can recharge the battery, as desired.

Inductive charging uses the electromagnetic field to transfer energy between a pair of objects. A charging station sends energy through inductive coupling to an electrical device. The electrical device stores the energy in the battery. Because there is a small gap between a pair of coils, inductive charging is one kind of wireless energy transfer. Induction charge is typically used on an induction coil to create an alternating electromagnetic field from within the charging base station. A second induction coil in the torque wrench takes power from the electromagnetic field and converts it back into electrical current to charge the battery. The two induction coils, in proximity, combine to form an electrical transformer. Greater distances can be achieved when the inductive charging system uses resonant inductive coupling. As such, since the batteries of each of the electrically-powered torque wrenches is located in proximity to the blowout preventer, it is possible to use resonant inductive coupling so as to effectively and selectively recharge the batteries associated with each of the torque wrenches. Inductive charging carries a far lower risk of electrical shock, when compared with conductive charging, since there are no exposed conductors. The ability to fully enclose the charging connection also makes the approach more attractive when use in a body of water, such as water 16. As such, the present invention is able to achieve the direct acoustic control of the valves of the blowout preventer through the use of the battery-powered electrical torque wrenches. As a result, the present invention is effectively able to avoid the use of hydraulics, hydraulic mechanisms and accumulators that are associated with the prior art.

Figure 2:
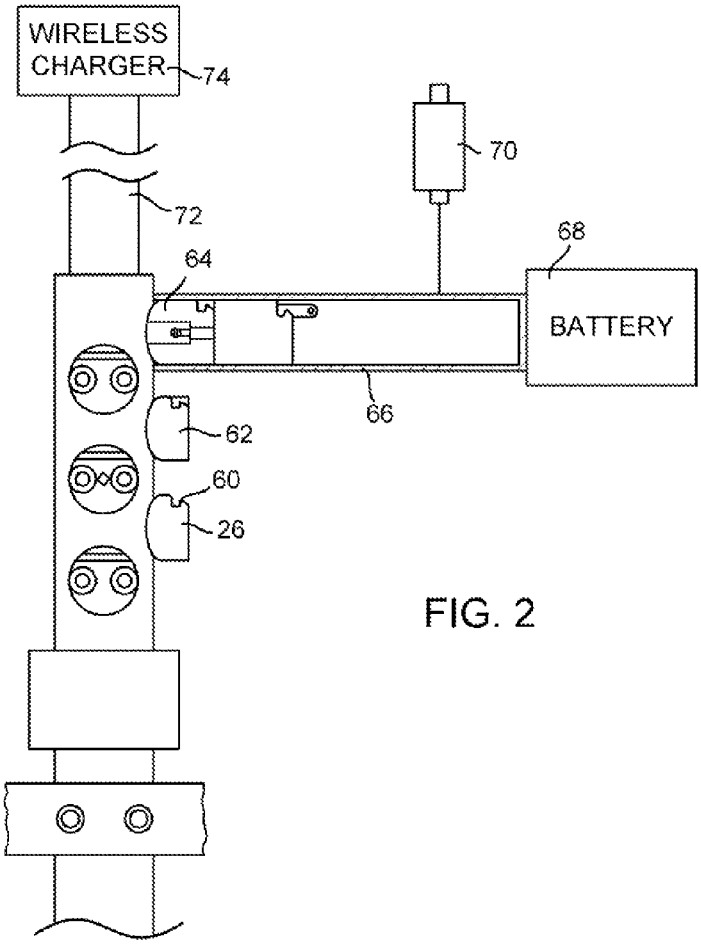
FIG. 2 is a detailed view showing the connection of the torque wrench to a control of the blowout preventer.

As can be seen in FIG. 2, the blowout preventer 26 is illustrated as having controls 60, 62 and 64 thereon. A single electrically-powered torque wrench 66 has been applied to control 64. The torque wrench 66 is illustrated as having battery 68 operatively connected thereto. The transponder 70 is electrically connected to the torque wrench 66. Transponder 70 is in a suitable location for receiving signals from the acoustic signal generator 42. Suitable electronics within the torque wrench 66 can operate from the signals received by the transponder 70 so as to allow the torque wrench to open or close the control 60 associated with the blowout preventer 26.

In FIG. 2, it can be seen that there is tubing 72 extending from the blowout preventer 26. The inductive charger 74 is illustrated, diagrammatically, as connected to the tubing 72 at a remote location. As such, the inductive charger 74 can transmit an electromagnetic wave along the steel of the tubing 72 and the steel of the blowout preventer 26 so as to create the necessary resonant inductive coupling with the battery 68. As such, the charging of the battery is effectively achieved.

Figure 3:
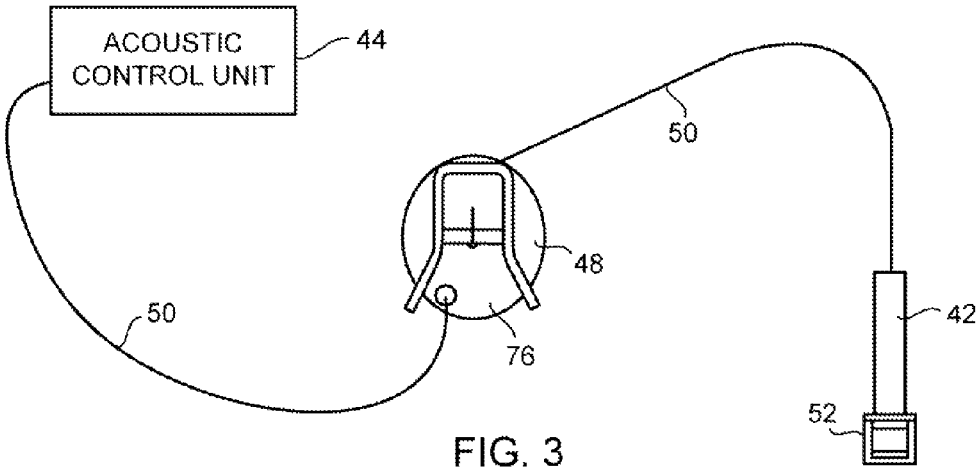
FIG. 3 is a diagrammatic illustration of the acoustic control unit associated with the acoustic signal generator of the present invention.

FIG. 3 illustrates the arrangement of the acoustic control unit 44 and the acoustic signal generator 42. As stated previously, the acoustic control unit 44 will be mounted on the ship 46. A cable 50 extends from the acoustic control unit 44 to the winch 48. The winch 48 includes a reel 76 around which the cable 50 is wrapped. The winch 48 can rotate in one direction or another so as to pay out or pay in the cable 50. Cable 50 is connected to the acoustic signal generator 42. The acoustic signal generator 42 has a head 52 to which the acoustic signal is transmitted. The winch 48 allows the acoustic signal generator 42 to be lowered to a desired location whereby the acoustic signal produced by the acoustic signal generator 42 can be properly transmitted to the transponders 30 (or transponder 70 as shown in FIG. 2).

Figure 4:
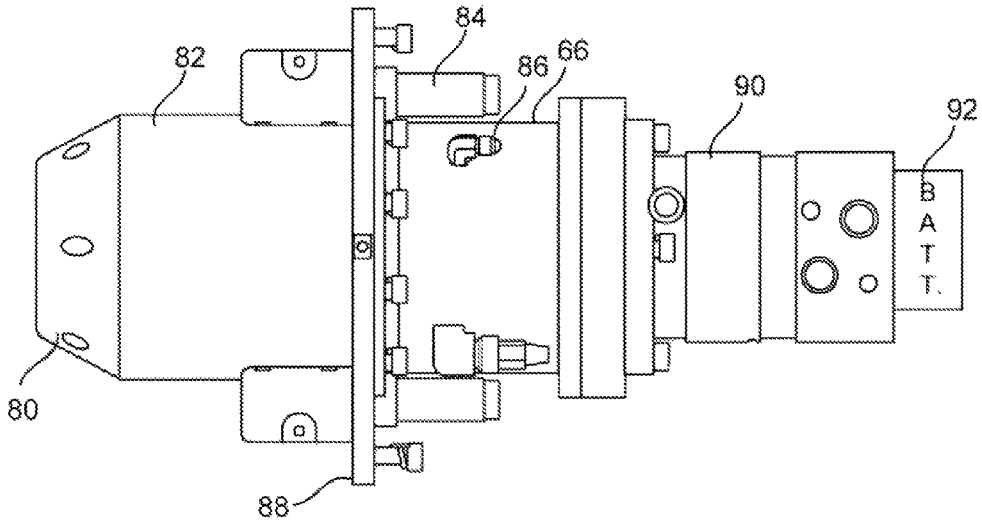
FIG. 4 is a side elevational view of a torque wrench as used in the present invention.

FIG. 4 is an illustration of the electrically-powered torque wrench 66 associated with the present invention. The torque wrench 66 includes a nose piece 80 located at one end thereof. The nose piece 80 will suitably extend against the blowout preventer 26 when it is in its fixed position. An effector housing 82 is located adjacent to the nose piece 80. Suitable locking cylinders 84 are provided on the effector housing 82. A gear box housing 86 is located to a side of the flange 88. The electrical motor 90 is positioned at the opposite end of the torque wrench 66 from the nose piece 80. As such, the electrical motor 90 can suitably drive shafts located within the interior of the torque wrench 66 for causing the requisite motion to the control of the blowout preventer. A battery 92 is located at the opposite end of the torque wrench 66.

Figure 5:
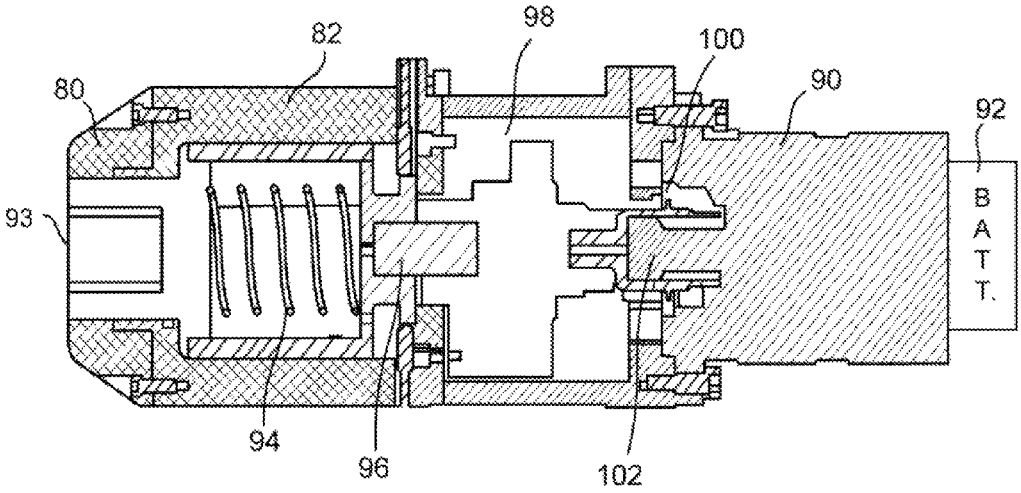
FIG. 5 is cross-sectional view of the torque wrench associated with the present invention.

FIG. 5, it can be seen that the there is an end effector 93 located in the nose piece 80. The end effector 93 will engage the control of the blowout preventer. A torque socket 94 is located within the effector housing 82. Torque socket 94 is engaged with the end effector 93. A torque adaptor 96 is engaged with the torque socket 94. Gear box 98 engages the torque adaptor 96 so as to impart rotational movement thereto. A motor adaptor 100 is suitably engaged with the electric motor 90 such that rotational movement of the shaft 102 of the electric motor 90 can cause a corresponding movement of the gear box 98 and the associated torque adaptor 96. Battery 92 serves to provide the requisite power to the electric motor 90.

Although it would seem to rather expensive to apply separate torque wrenches to each of the controls of the blowout preventer, it has been found that such application is actually very cost effective in comparison with the hydraulic connections, the ROV uses, and the other mechanisms associated with the control systems of the prior art.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A control system comprising:

a blowout preventer having a control thereon;

a pipe extending upwardly from said blowout preventer;

an acoustic signal generator;

a transponder positioned remotely from said acoustic signal generator;

an electrically-powered torque wrench connected to said transponder, said transponder extending outwardly of said torque wrench, said torque wrench having a head directly connected to said control of said blowout preventer, said acoustic signal generator suitable for passing a signal to said transponder so as to drive said torque wrench;

a battery electrically connected to said torque wrench so as to supply power to said torque wrench; and an induction generator connected to said pipe so as to resonantly electrically charge said battery of said torque wrench.

2. The system of claim 1, further comprising:

an acoustic control unit connected by a cable to said acoustic signal generator.

3. The system of claim 2, further comprising:

a ship positioned above said transponder, said acoustic control unit positioned on said ship.

4. The system of claim 3, further comprising:

a winch having a cable reel thereon, said cable extending around said cable reel, said winch positioned on said ship, said winch being operable so as to raise or lower said acoustic signal generator.

5. The system of claim 1, said acoustic signal generator transmitting sonar signals, said transponder receiving sonar signals.

6. The system of claim 5, said transponder comprising a plurality of transponders, said actuator comprising a plurality of actuators separately connected to said blowout preventer, said plurality of transponders respectively connected to said plurality of actuators, said acoustic signal generator transmitting a sonar signal of a frequency or volume corresponding to a desired actuation of one of said plurality of actuators.

7. A control system comprising:

a blowout preventer having a plurality of controls thereon;

a pipe extending upwardly from said blowout preventer;

a plurality of torque wrenches respectively affixed to said plurality of controls, each of said plurality of torque wrenches having a transponder connected thereto, each of said plurality of torque wrenches being electrically powered;

an acoustic signal generator positioned remotely from the transponders, said acoustic signal generator for producing an acoustic signal so as to actuate at least one of said plurality of torque wrenches;

a plurality of batteries electrically connected respectively to said plurality of torque wrenches so as to supply power to the torque wrenches; and an induction generator connected to said pipe so as to resonantly electrically charge at least one battery of said plurality of batteries.

8. A system for use in a body of water, the system comprising:

a blowout preventer having a plurality of controls thereon, said blowout preventer having tubing extending therefrom toward a surface of the body of water;

a plurality of electrically-powered wrenches affixed respectively to said plurality of controls, each of said plurality of electrically-powered wrenches being powered by a battery;

an induction generator connected to said tubing so as to send an electromagnetic wave along said tubing so as to selectively resonantly recharge the batteries, the batteries not being electrically connected to said tubing;

a plurality of transponders connected respectively to said plurality of electrically-powered wrenches;

an acoustic signal generator positioned remotely from said plurality of transponders, said acoustic signal generator suitable for transmitting an acoustic signal so as to actuate at least one of said plurality of electrically-powered wrenches;

an acoustic control unit connected by a cable to said acoustic signal generator;

a ship positioned above the transponders, said acoustic control unit positioned on said ship; and a winch having a cable reel thereon, said cable extending around said cable reel, said winch positioned on said ship, said winch being operable so as to raise or lower said acoustic signal generator, said acoustic signal generator transmitting a sonar signal of a frequency or volume corresponding to a desired actuation of at least one of said plurality of electrically-powered wrenches.

* * * * *